US009268309B2

(12) United States Patent
Karsch

(10) Patent No.: US 9,268,309 B2
(45) Date of Patent: Feb. 23, 2016

(54) TIMEPIECE WITH ROTATING MOON AND EARTH DISPLAYS

(71) Applicant: Mario Karsch, Dohna (DE)

(72) Inventor: Mario Karsch, Dohna (DE)

(73) Assignee: Lange Uhren GmbH, Glashütte (DE)

( * ) Notice: Subject to any disclaimer, the term of this patent is extended or adjusted under 35 U.S.C. 154(b) by 0 days.

(21) Appl. No.: 14/467,853

(22) Filed: Aug. 25, 2014

(65) Prior Publication Data

US 2015/0063077 A1 Mar. 5, 2015

(30) Foreign Application Priority Data

Aug. 27, 2013 (DE) ..... 10 2013 109 288

(51) Int. Cl.

| | |
|---|---|
| ***G04B 19/26*** | (2006.01) |
| ***G04B 3/04*** | (2006.01) |
| ***G04B 49/00*** | (2006.01) |

(52) U.S. Cl.

CPC ..... *G04B 19/268* (2013.01); *G04B 3/04* (2013.01); *G04B 49/00* (2013.01)

(58) Field of Classification Search

CPC .... G04B 19/26; G04B 19/268; G04B 19/262; G04B 49/00; G04B 3/04; G09B 27/00; G09B 27/02; G09B 27/06

USPC ..... 368/15–18

See application file for complete search history.

(56) References Cited

U.S. PATENT DOCUMENTS

| | | | | | |
|---|---|---|---|---|---|
| 557,173 | A * | 3/1896 | Thompson | 368/27 |
| 2,943,435 | A * | 7/1960 | Gorsuch | 368/18 |
| 4,548,512 | A | 10/1985 | Erard | |
| 4,583,864 | A * | 4/1986 | Graves | 368/17 |
| 4,671,669 | A * | 6/1987 | Graves | 368/17 |
| 5,197,043 | A * | 3/1993 | Strader | 368/27 |
| 5,529,500 | A * | 6/1996 | Dahlman | 434/292 |
| 5,917,778 | A * | 6/1999 | James et al. | 368/17 |
| 8,743,664 | B2 | 6/2014 | Mintiens | |
| 2004/0156269 | A1 * | 8/2004 | Plange et al. | 368/17 |

(Continued)

FOREIGN PATENT DOCUMENTS

| | | | | |
|---|---|---|---|---|
| CH | 679197 | * | 1/1992 | G04B 19/26 |
| JP | 59-99387 | | 6/1984 | |
| JP | 60-60580 | | 4/1985 | |

(Continued)

OTHER PUBLICATIONS

English Translation of Oechslin, CH 679,197, Published Jan. 15, 1992, translated May 7, 2015.*

*Primary Examiner* — Amy Cohen Johnson
*Assistant Examiner* — Matthew Powell
(74) *Attorney, Agent, or Firm* — Cozen O'Connor

(57) ABSTRACT

A timepiece includes: a central pivot; a central disk rotatable in a clockwise or counterclockwise direction around the central pivot; a stationary 24-hour scale arranged concentric to the central pivot; a sun mark; a large moon disk, the large moon disk being rotatably drivable in the counterclockwise direction at a rate of one revolution per synodic month; a moon view aperture in the large moon disk; and a small moon disk mounted at the large moon disk so as to be rotatable around a moon pivot parallel to the central pivot, the small moon disk carrying a plurality of dark circular areas. The dark circular areas are movable successively into registration with the moon view aperture and successively out of registration with the moon view aperture by the rotational movement of the small moon disk.

19 Claims, 18 Drawing Sheets

(56) References Cited

U.S. PATENT DOCUMENTS

| | | | | |
|---|---|---|---|---|
| 2005/0105397 | A1* | 5/2005 | Tuason | 368/21 |
| 2006/0221771 | A1* | 10/2006 | Zimmermann et al. | 368/16 |
| 2014/0112108 | A1* | 4/2014 | Orny et al. | 368/18 |
| 2014/0126336 | A1* | 5/2014 | Goeller et al. | 368/15 |

FOREIGN PATENT DOCUMENTS

| | | |
|---|---|---|
| JP | 62-186091 | 11/1987 |
| JP | 05-126964 | 5/1993 |
| JP | 2009-216547 | 9/2009 |
| JP | 2013-513115 | 4/2013 |

* cited by examiner

TIMEPIECE WITH ROTATING MOON AND EARTH DISPLAYS

BACKGROUND OF THE INVENTION

1. Field of the Invention

The invention is directed to a timepiece, in particular a wristwatch, with a timepiece movement by which an hour display and possibly a minute display and a seconds display can be driven, with a central disk that can be driven so as to be rotatable in clockwise or counterclockwise direction around a central pivot by one revolution per 24 hours and on the surface of which is depicted the southern hemisphere or northern hemisphere of the earth or the degrees of longitude thereof, wherein the central pivot passes through the pole of the hemisphere, with a stationary hour scale arranged concentric to the central pivot and with a sun mark arranged in a stationary manner in the 1200 hours position at a radial distance from the central pivot.

2. Description of the Related Art

In a timepiece of the type mentioned above, it is known to display the region of the earth's northern hemisphere that is illuminated by the sun.

SUMMARY OF THE INVENTION

It is an object of the invention to provide a timepiece of the type mentioned above which constructed in a simple manner and on which the position of the sun and the phases of the moon are displayed in relation to a determined standpoint on the earth's southern hemisphere or northern hemisphere.

This object is met according to the invention in that the hour scale is a 24-hour scale and the central disk is surrounded concentrically radially inside of the 24-hour scale by a large moon disk and is rotatably drivable in the counterclockwise direction with one revolution per synodic month (29 days, 12 hours, 44 minutes, 2.9 seconds), with a moon view aperture in the large moon disk, and with a small moon disk mounted at the large moon disk so as to be rotatable around a moon pivot parallel to the central pivot and which carries a plurality of dark circular areas corresponding to the moon view aperture uniformly distributed on a pitch circle, and which small moon disk is rotatably drivable in a ratio to the rotational movement of the large moon disk, wherein the dark circular areas can be moved successively into registration with the moon view aperture and successively out of registration with the moon view aperture by the rotational movement of the small moon disk.

It will be appreciated that the synodic month need not be exactly 29 days, 12 hours, 44 minutes, 2.9 seconds, but can also be a time period of a synodic month in round terms having sufficient accuracy.

The time on the 24-hour scale and the positions of the sun and moon from the perspective of the observer can be read in an imaginary line of longitude over the standpoint of the observer to the 24-hour scale on the central disk.

The small moon disk can be rotatably supported at the large moon disk on the side remote of an observer so as to take up as little space as possible.

In so doing, the small moon disk can carry two dark circular areas and can be drivable at half of the rotational speed of the large moon disk.

When the small moon disk has a concentric small moon disk toothing that engages in the toothing of a toothed wheel arranged in a stationary manner coaxial to the central pivot, the small moon disk rolls along the toothed wheel by the rotational movement of the large moon disk and accordingly acquires its rotational movement.

For the rotational driving of the large moon disk, the large moon disk can have a concentric large moon disk toothing in which a driving pinion engages, wherein by making use of the timepiece movement of the timepiece the driving pinion can be rotatably drivable via a gear train of the timepiece movement of the timepiece.

The central disk, large moon disk and small moon disk can be rotatably drivable by the timepiece movement of the timepiece via the gear train, and the hour display and possibly the minute display and the seconds display can be adjustable when the central disk, large moon disk and small moon disk are decoupled from the timepiece movement by a decoupling device. In this way, the hour display can be adjusted for a time zone change, but the central disk and the large moon disk are not also adjusted along with it.

The hour display and possibly the minute display and the seconds display can be formed by any suitable display elements. They are preferably formed by an hour hand, minute hand and seconds hand.

To adjust the hour display and possibly the minute display and the seconds display, the hour display and possibly the minute display and the seconds display are preferably adjustable by a setting device movable between a setting position and a non-setting position.

By adjusting the adjusting device, the decoupling device can be provided for a decoupling automatically when the decoupling device is adjustable by the setting device between a decoupling position and a non-decoupling position, wherein the timepiece movement is decoupled from the central disk, the large moon disk and the small moon disk in the decoupling position and the timepiece movement is coupled with the central disk, the large moon disk and the small moon disk in the non-decoupling position.

The setting device is preferably an axially displaceable winding stem of the timepiece.

For manual actuation of the decoupling device and actual decoupling, the decoupling device can have an actuating element by which the gear train can be decoupled from the timepiece movement for the central disk, large moon disk and small moon disk via the decoupling device at a decoupling location in the decoupling position of the decoupling device.

When part of the gear train can be blocked against rotation in driving direction downstream of the decoupling location when the gear train is decoupled, this part of the gear train which is now without power and, along with it, the settings of the central disk, large moon disk and small moon disk cannot be adjusted. They remain in their blocked position until coupled into the gear train again and blocking is canceled.

In order to correct the lunar phase, the large moon disk can be adjustable manually in counterclockwise direction, wherein the large moon disk is preferably adjustable in steps of a synodic day for simple correction.

To this end, a wheel of the gear train can be adjustable by an adjusting device, which can be actuated manually and which is arranged on an arbor by means of a slip clutch, which arbor is fixedly connected coaxially to a further, upstream wheel of the gear train.

This wheel of the gear train is preferably a driving pinion and is therefore also used in a dual functioning manner for correcting the lunar phase.

By use of the slip clutch, the wheel can be turned by the adjusting device without also turning the upstream wheel.

In a simple construction, the manually adjustable adjusting device can have a first swivel lever that can be swivelably deflected by a second actuating element from an idle position to an adjusting position and by which a second swivel lever can be swivelably deflected, this second swivel lever having a setting nose which engages in the driving pinion or an intermediate toothed wheel through the deflection of the second swivel lever and rotates this driving pinion or intermediate toothed wheel by a synodic day for adjusting the large moon disk.

The sun mark can be formed by the balance of the timepiece arranged radially outside of the hour scale, which balance accordingly exercises a dual function.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An embodiment example of the invention is shown in the drawings and is described more fully in the following. In the drawings.

DETAILED DESCRIPTION OF THE PRESENTLY PREFERRED EMBODIMENTS

Figure 1:
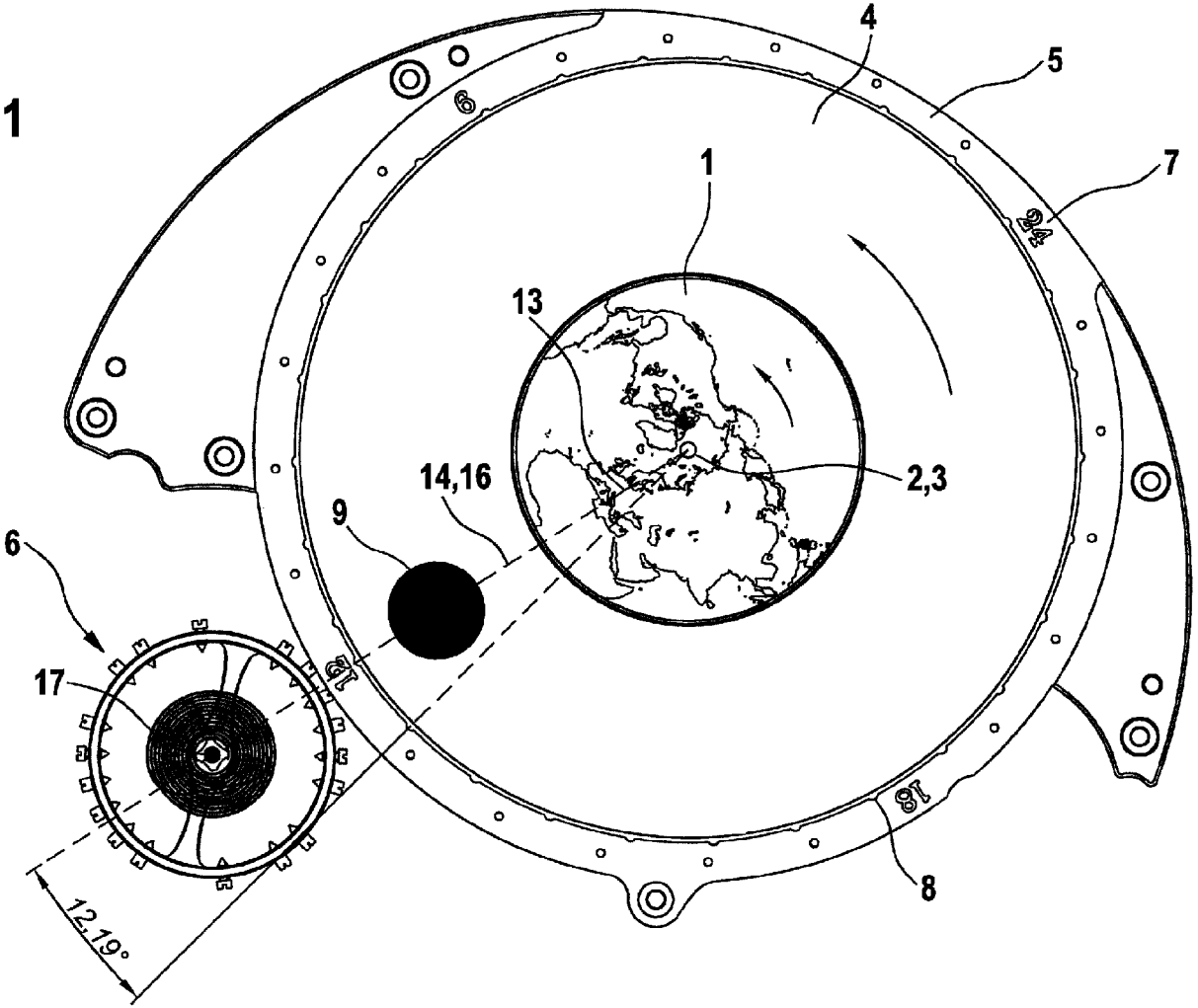
FIG. 1 is a top view of the display of a timepiece in a new-moon position.

In FIG. 1, a round central disk 1 is drivable so as to be rotatable around a coaxial central pivot 2 with one revolution every 24 hours. The earth's northern hemisphere is depicted on the central disk 1 such that the central pivot 2 passes through the north pole 3.

The central disk 1 is surrounded concentrically by an annular large moon disk 4 that is likewise drivable so as to be rotatable around the central pivot 2 with one revolution per synodic month (29 days, 12 hours, 44 minutes, 2.9 seconds). It will be appreciated that the synodic month need not be exactly 29 days, 12 hours, 44 minutes, 2.9 seconds, but can also be a rounded-off time period of a synodic month having sufficient accuracy.

The large moon disk 4 is in turn surrounded concentrically by a stationary annular 24-hour scale 5 which has twenty-four hour marks 7 in addition to thirty lunar phase indices 8. The lunar phase indices 8 are evenly spaced apart starting from the 1200 hours position also corresponding to the new-moon position in the counterclockwise direction by the angular amount for a daily synodic lunar phase. There is then another distance of about 0.5 days from the twenty-ninth lunar phase index 8 to the first lunar phase index 8.

A balance 6 of the timepiece forming a sun mark is arranged in a stationary manner radially outside of the 24-hour scale 5 in the 1200 hours position.

A circular moon view aperture 9 is formed in the large moon disk 4.

The diameter of the central disk 1 and the diameter of the moon view aperture 9 are selected such that they have the same size proportions as the Earth and Moon in nature.

Figure 18:
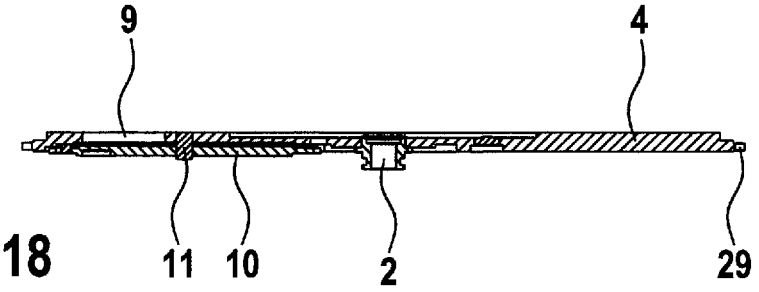
FIG. 18 is a section along line XVII-XVII in FIG. 17.
Figure 17:
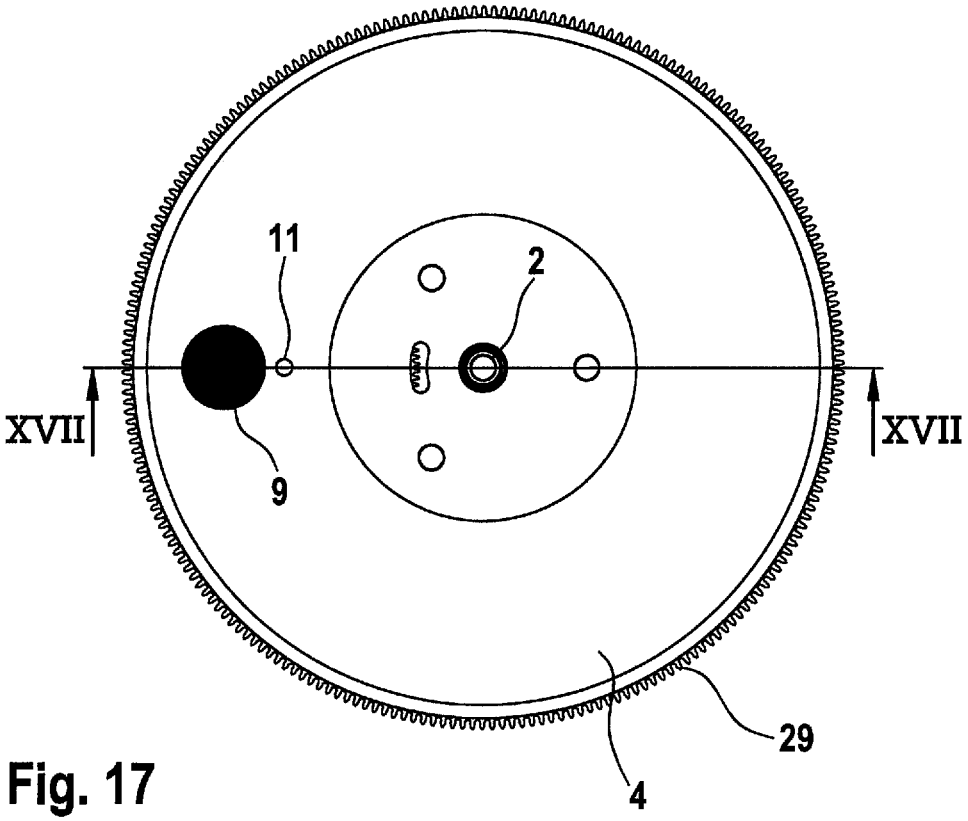
FIG. 17 is a top view of a large moon disk of the timepiece according to FIG. 1.

A small moon disk 10 is supported on the back of the large moon disk 4, i.e., on the side remote of an observer, so as to be rotatable around a moon pivot 11 parallel to the central pivot 2 and is rotatably drivable in the counterclockwise direction at half of the rotational speed of the large moon disk 4 (see particularly FIGS. 17 and 18).

On its light surface facing the large moon disk 4, the small moon disk 10 carries two dark circular areas 12 which are located diametrically opposite to the moon pivot 11 and can be moved successively into registration and out of registration with the moon view aperture 9 having the same size by the rotational movement of the small moon disk 10.

The large moon disk 4 also rotates at the same time, the rotation of the large moon disk 4 being measured by the meridian 16 passing through the center 17 of the balance 6.

Accordingly, the observer can see the current phase of the moon through the moon view aperture 9.

During rotation of the central disk 1, the area of the northern hemisphere directed toward the balance 6 is illuminated by the sun.

FIGS. 1 to 9 show the central disk 1 and the lunar phases in various positions. The depictions always refer to the present location 13 of the observer on the depicted northern hemisphere, which corresponds approximately to the position of Germany in the present instance.

The time is read in that an imaginary straight line 14 is drawn from the north pole 3 over the location 13 of the observer to the 24-hour scale 5 on which the time can then be read. This imaginary line 14 also corresponds to the longitude on which the location 13 of the observer is situated.

In FIG. 1, it is 1200 hours in Germany. The imaginary line 14 passes through the center of the balance 6 so as to overlap the meridian 16 and therefore also through the sun which has reached its highest point in the south. The moon is in the new moon lunar phase, which can be signified in that the moon view aperture 9 is completely filled up by a dark circular area 12.

Figure 2:
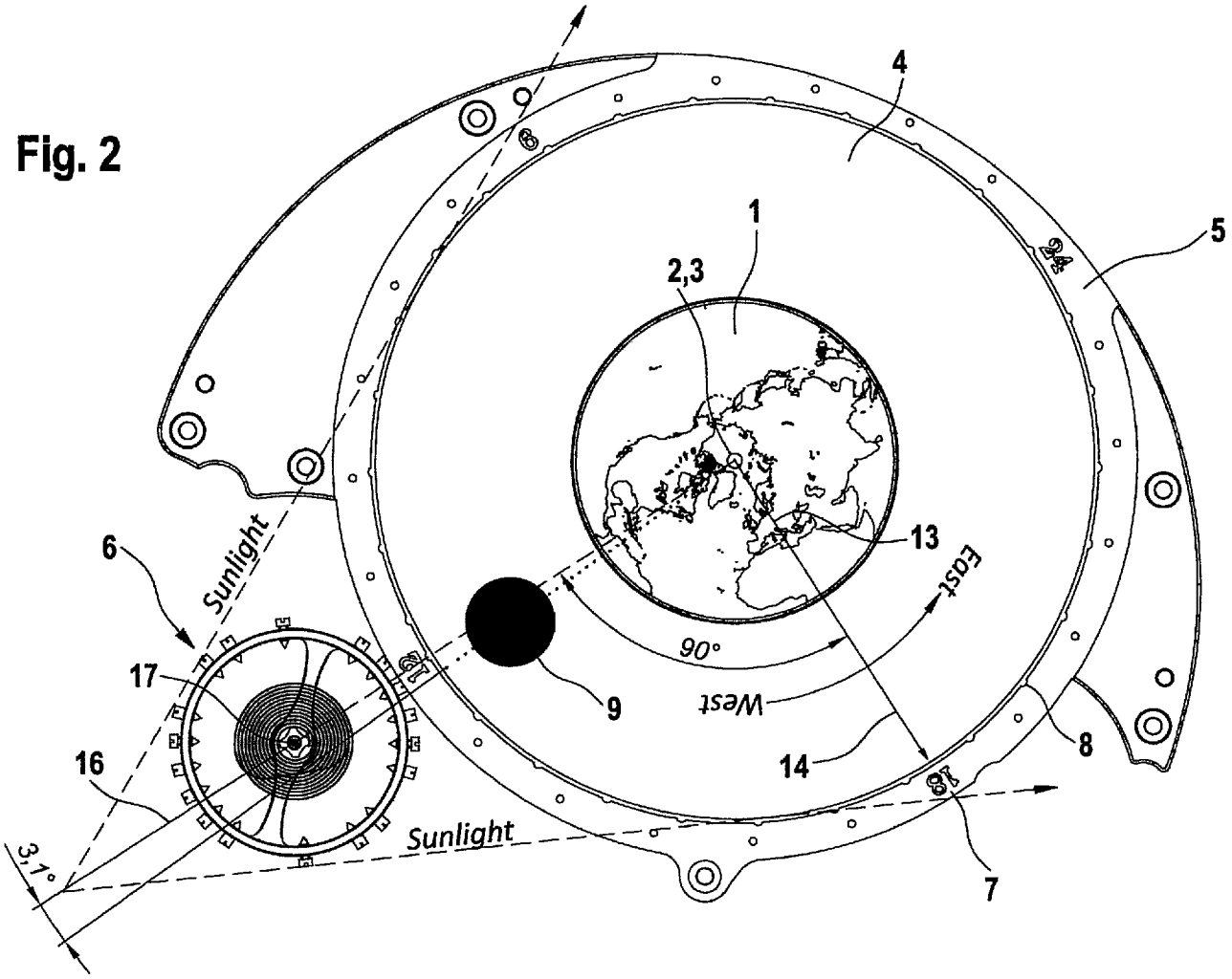
FIG. 2 is a top view of the display of the timepiece according to FIG. 1 in a first onward movement from the new-moon position.

FIG. 2 shows the settings six hours later. The central disk 1 has moved onward by 90° with respect to the initial position in FIG. 1. It is now 1800 hours at the location 13 of the observer. The observer must look toward the right in westward direction to view the balance 6 and, therefore, the sun. The moon view aperture has rotated by 3.1° in counterclockwise direction.

Figure 3:
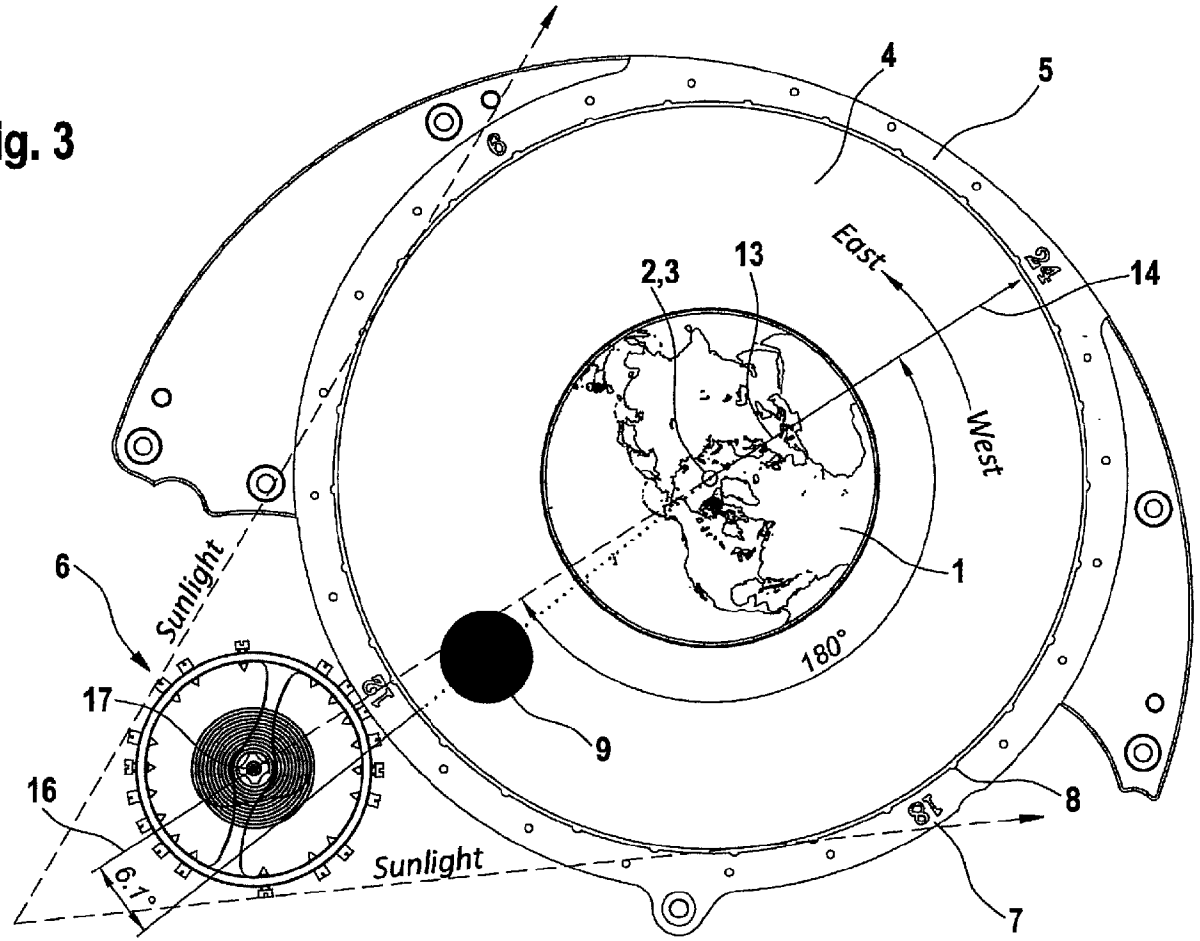
FIG. 3 is a top view of the display of the timepiece according to FIG. 1 in a second onward movement from the new-moon position.

In FIG. 3, the central disk 1 has moved farther by 180° relative to the initial position in FIG. 1 after twelve hours. It is now 2400 hours and nighttime at the location 13 of the observer in Germany. The moon view aperture has rotated by 6.1° in counterclockwise direction.

Figure 4:
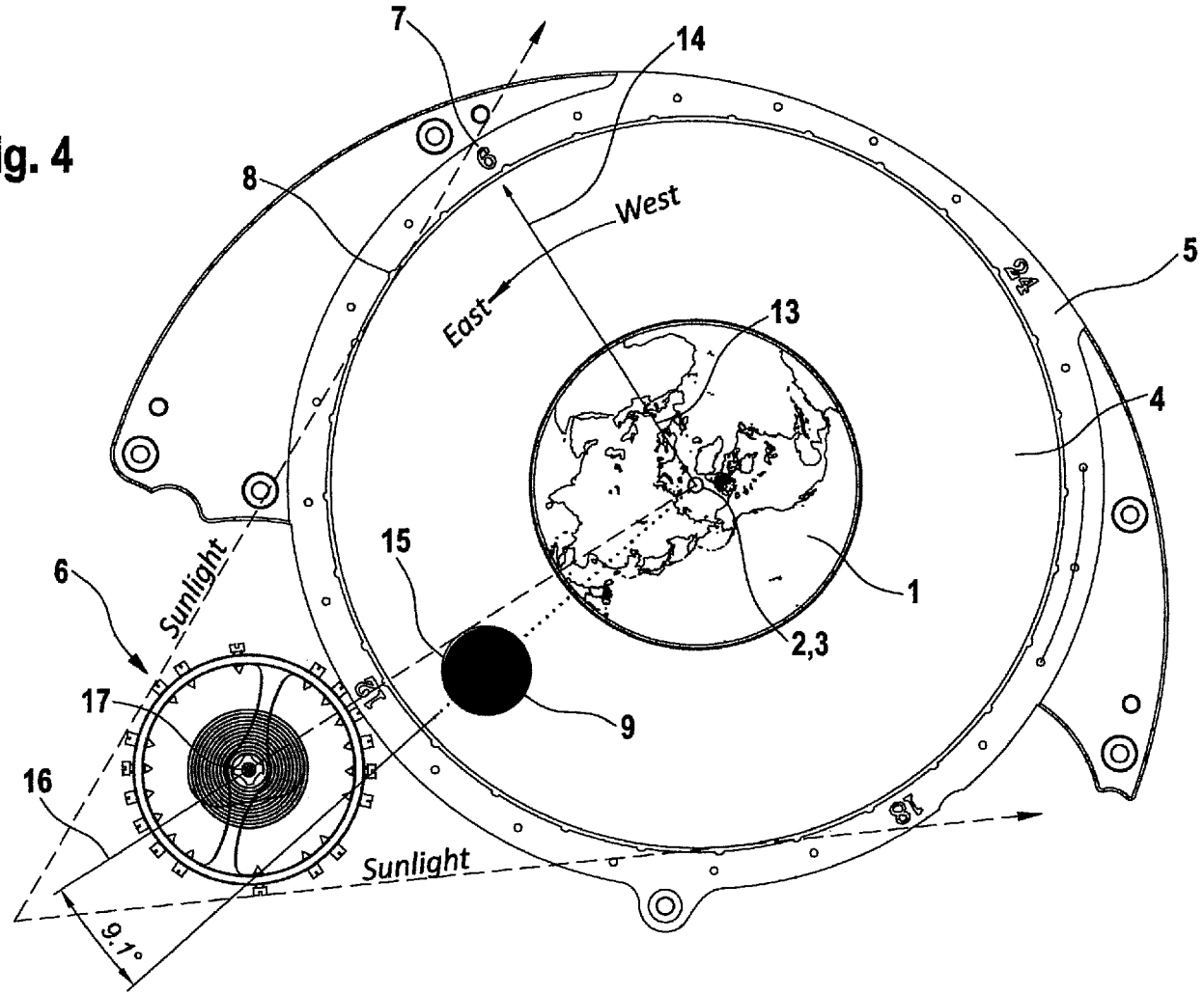
FIG. 4 is a top view of the display of the timepiece according to FIG. 1 in a third onward movement from the new-moon position.

In FIG. 4, the central disk 1 has moved farther by 270° relative to the initial position in FIG. 1 after eighteen hours. It is now 0600 hours at the location 13 of the observer in Germany. The observer must look toward the left in eastward direction to view the balance 6 and, therefore, the sun. Since the large moon disk 4 and the small moon disk 10 also move continuously, a very small crescent of the moon 15 can now be seen after eighteen hours. The moon view aperture has rotated by 9.1° in counterclockwise direction.

Since the moon view aperture 9 and, therefore, the moon 15 moves around the earth and the angle of sun (balance 6), earth (central disk 1) and moon (moon view aperture 9) constantly changes, the moon is always illuminated by sunlight at a different place. The observer sees the waxing moon 15 from his location 13 based on the crescent shape of the moon 15.

Figure 5:
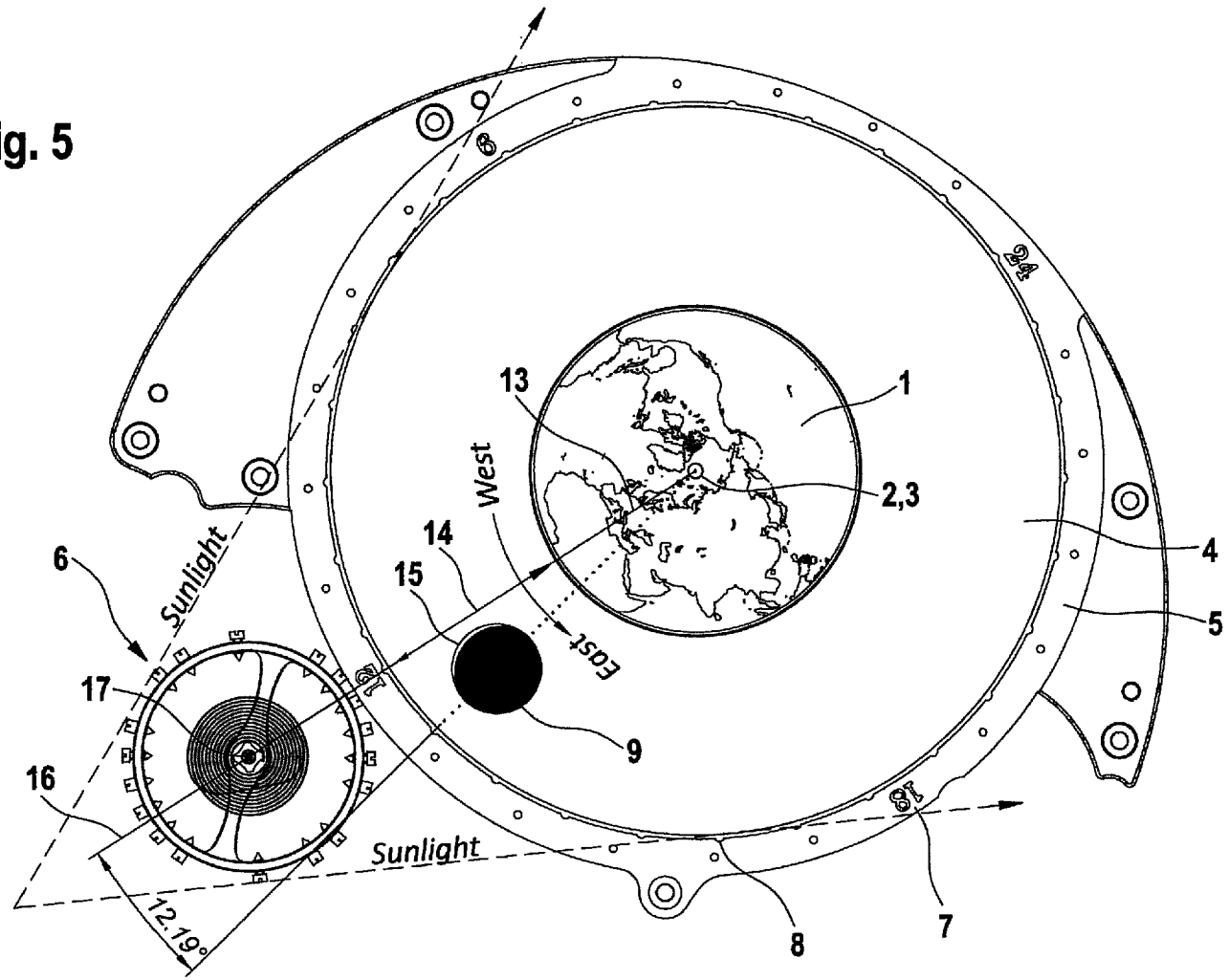
FIG. 5 is a top view of the display of the timepiece according to FIG. 1 in a fourth onward movement from the new-moon position.

In FIG. 5, after twenty-four hours and a 360-degree rotation of the central disk 1, the central disk 1 has again reached its starting point from FIG. 1.

It is now 1200 hours at the location 13 of the observer, the sun crosses the meridian 16, the highest position of the sun at this location 13. As the central disk 1 moves onward, the observer looking westward will first see the setting of the sun and then a little later during twilight the narrow crescent of the waxing moon 15 which will soon also disappear below the horizon in the west.

Figure 6:
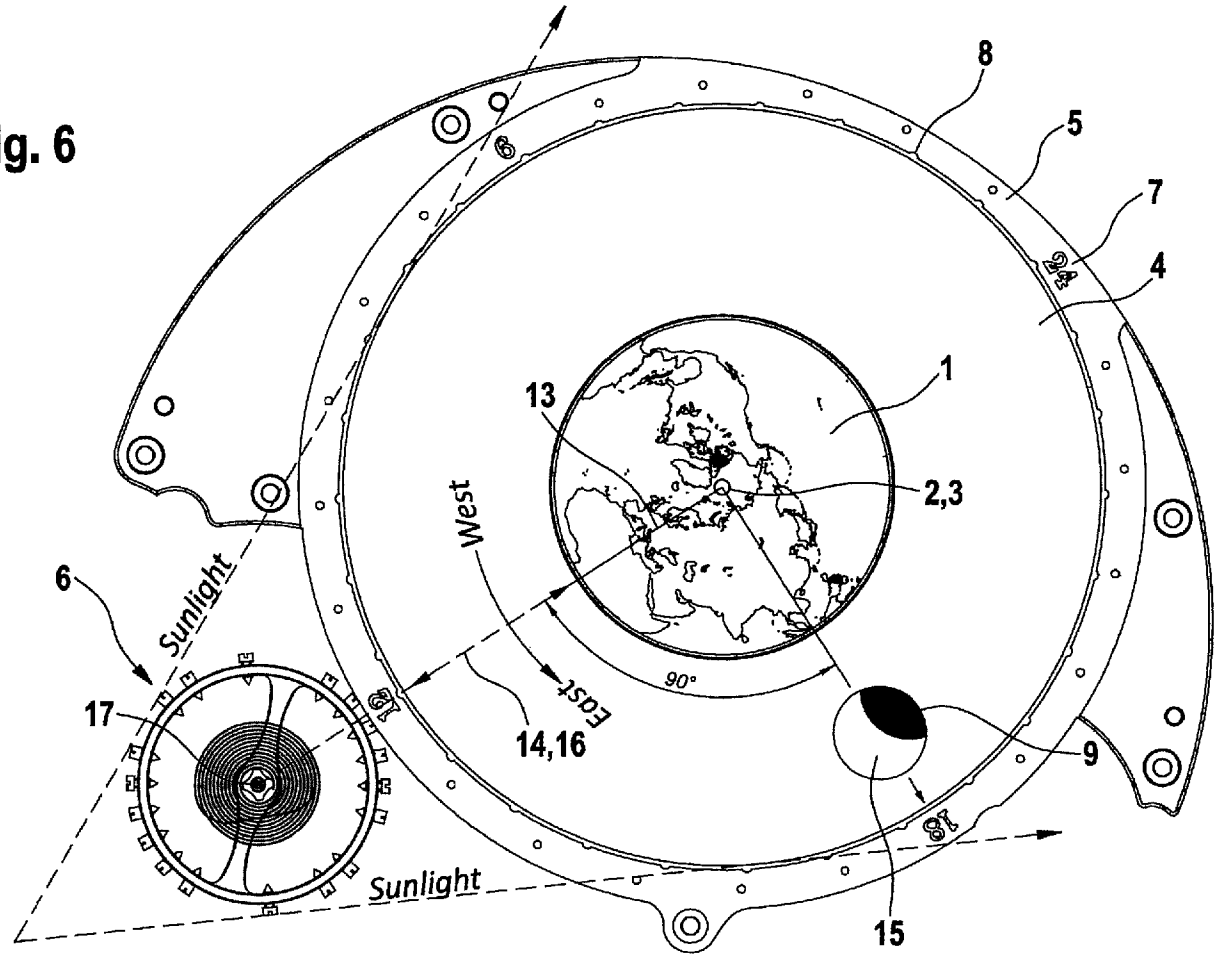
FIG. 6 is a top view of the display of the timepiece according to FIG. 1 in a half-moon position in the first-quarter lunar phase.

In FIG. 6, the moon view aperture 9 has now moved farther by 90° relative to meridian 16. The sun (balance 6) illuminates half of the moon 15. The half-moon or first quarter has now been reached at the location 13 of an observer. It is 12 o'clock noon, the sun is at its highest point in the sky. When the observer looks eastward from his location 13, he sees the moon 15 rising on the eastern horizon. After six hours, the earth (central disk 1) has rotated to the extent that the moon has reached its highest position from the location 13 of the observer at about 1800 hours. As the earth (central disk 1) continues to move and 2400 hours is reached, the observer must look westward from his location 13 to see the moon 15. The large moon disk 4 has covered this angular amount in about 7.4 days.

Figure 7:
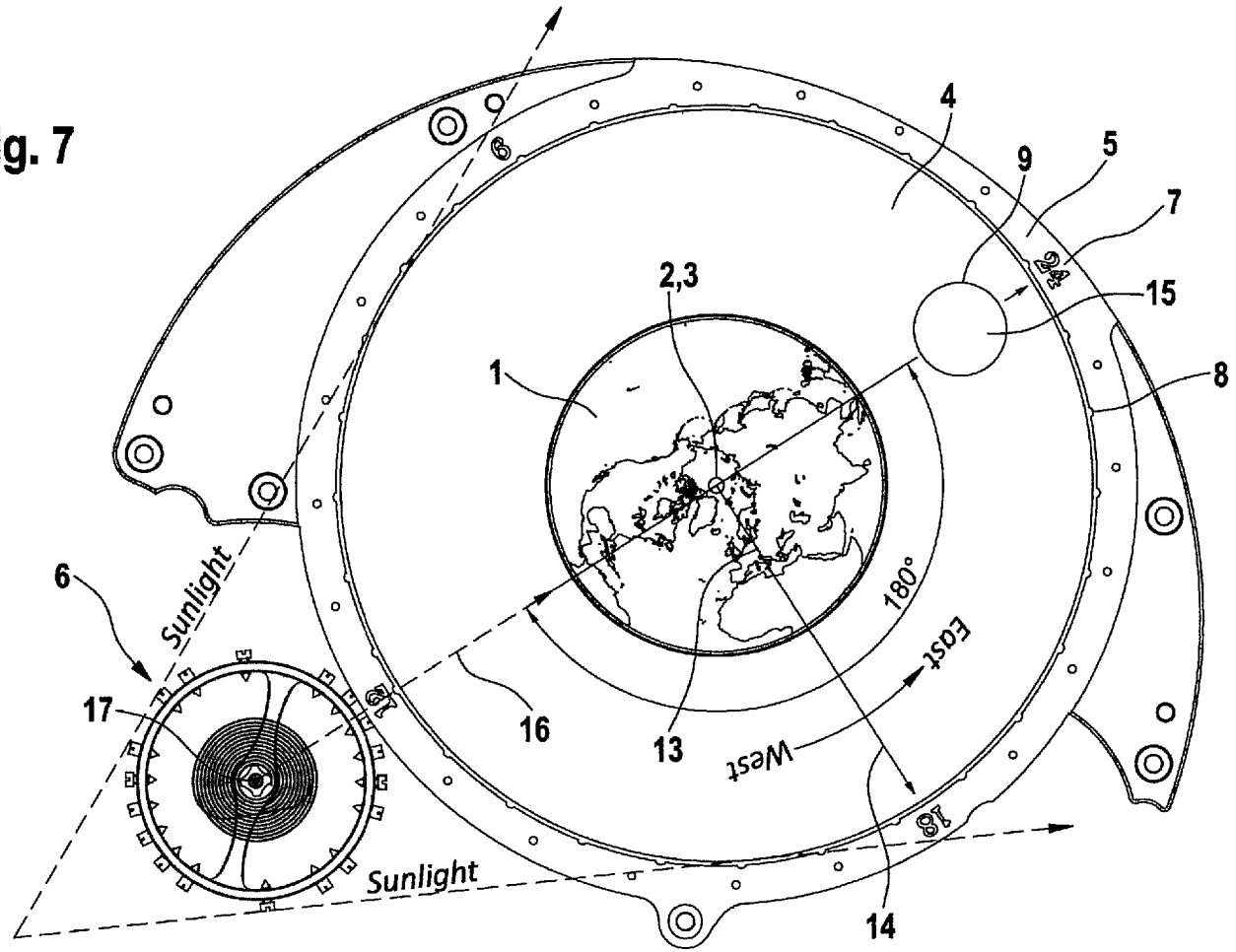
FIG. 7 is a top view of the display of the timepiece according to FIG. 1 in a full-moon position.

In FIG. 7, the moon view aperture 9 is located opposite the sun (balance 6) and the moon is full. An observer sees the full moon in the east from his location 13 at 1800 hours. At about 2400 hours, the moon has reached its highest point, and at 0600 hours the moon is seen on the western horizon in relation to location 13. The large moon disk 4 has moved 180° in about 14.8 days.

Figure 8:
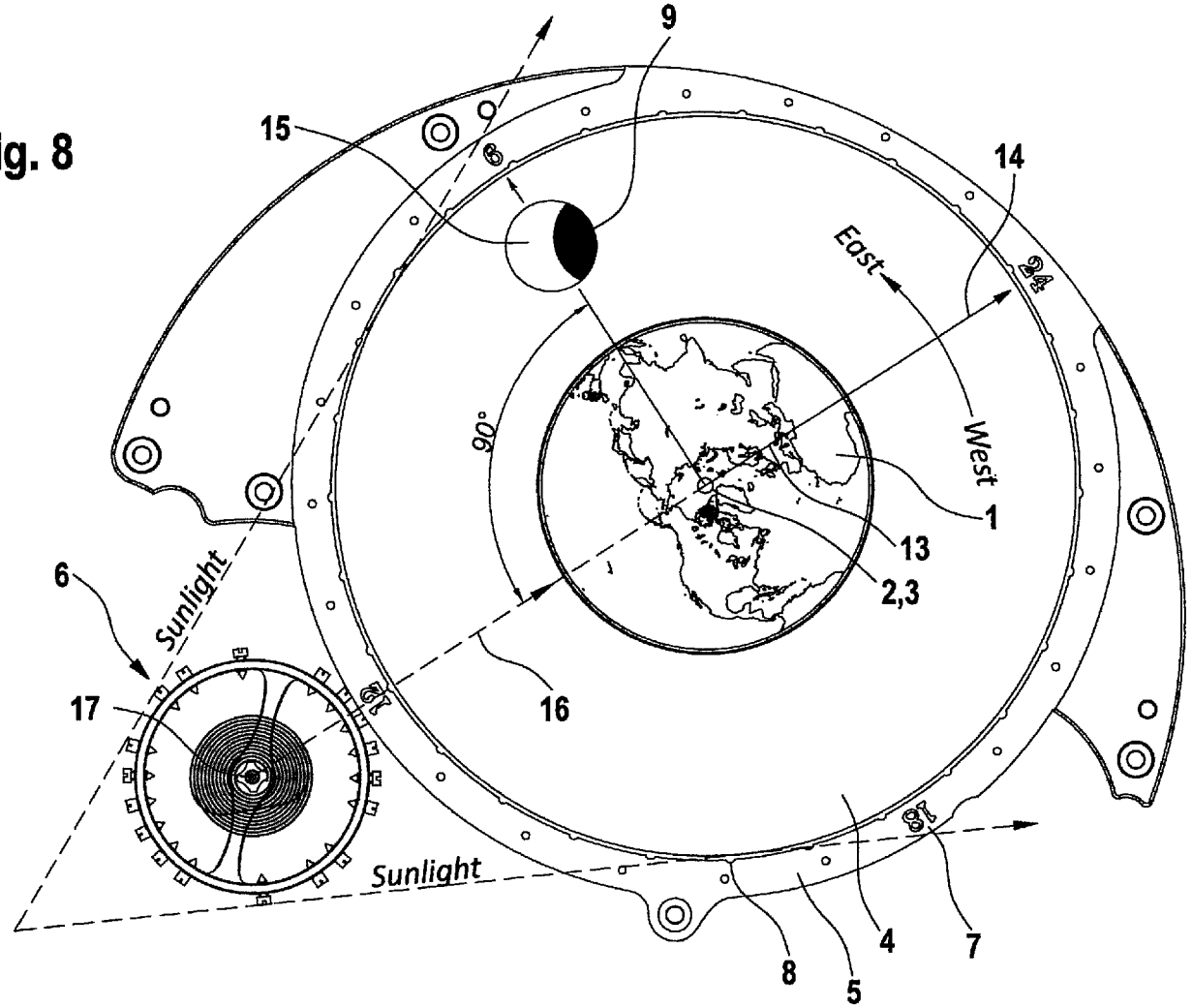
FIG. 8 is a top view of the display of the timepiece according to FIG. 1 in a half-moon position in the last-quarter lunar phase.

In FIG. 8, the moon view aperture 9 is again located at an angle of 90° between the sun (balance 6) and central disk 1 and the moon is waning. From location 13 of an observer, the moon rises on the eastern horizon at midnight, it reaches its highest position at about 0600 hours, and the moon is seen on the western horizon at around 1200 hours, always in relation to location 13. The large moon disk 4 has covered an angle of 270° in about 22.1 days.

Figure 9:
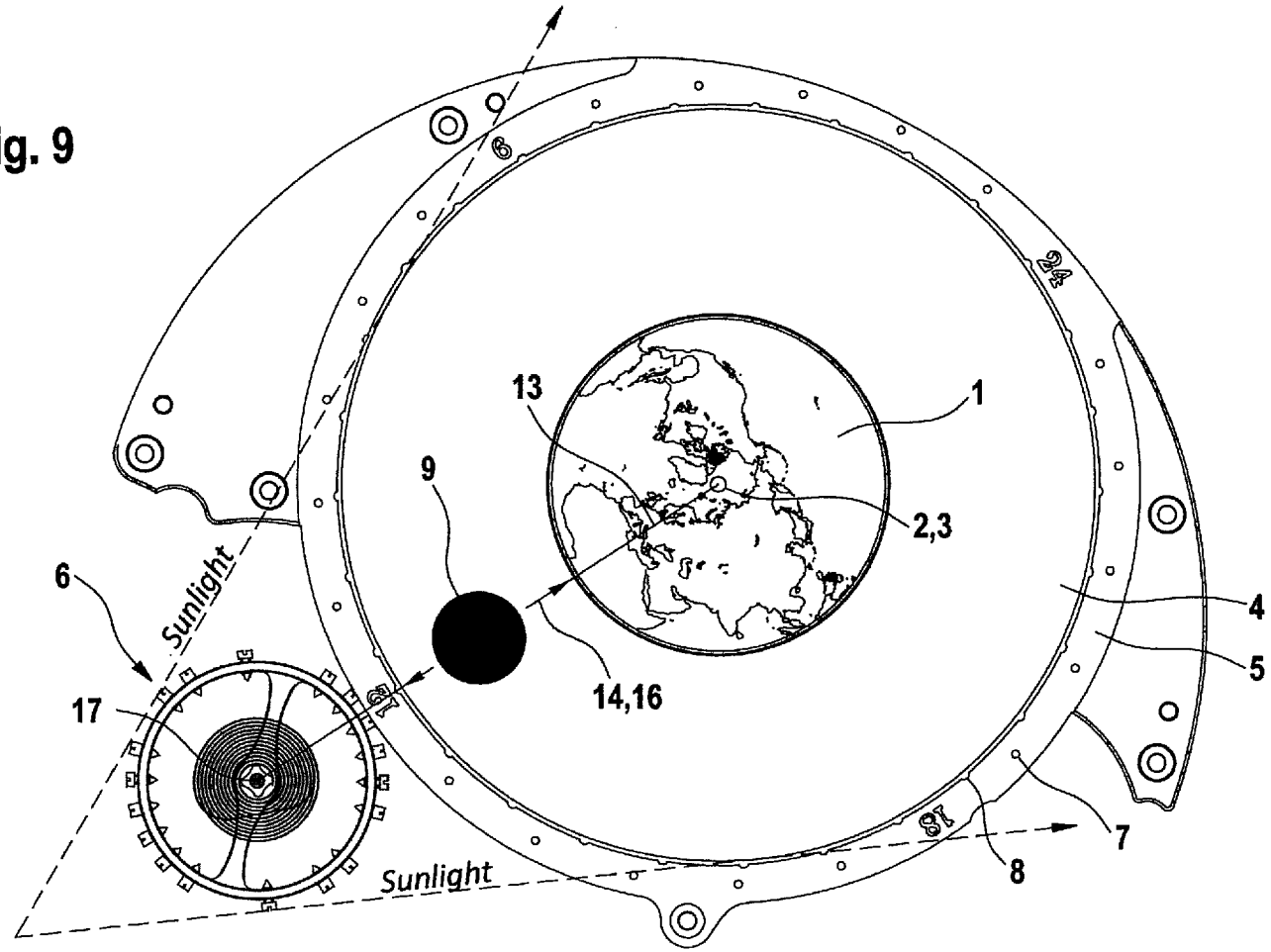
FIG. 9 is a top view of the display of the timepiece according to FIG. 1 in a new-moon position.
Figure 10:
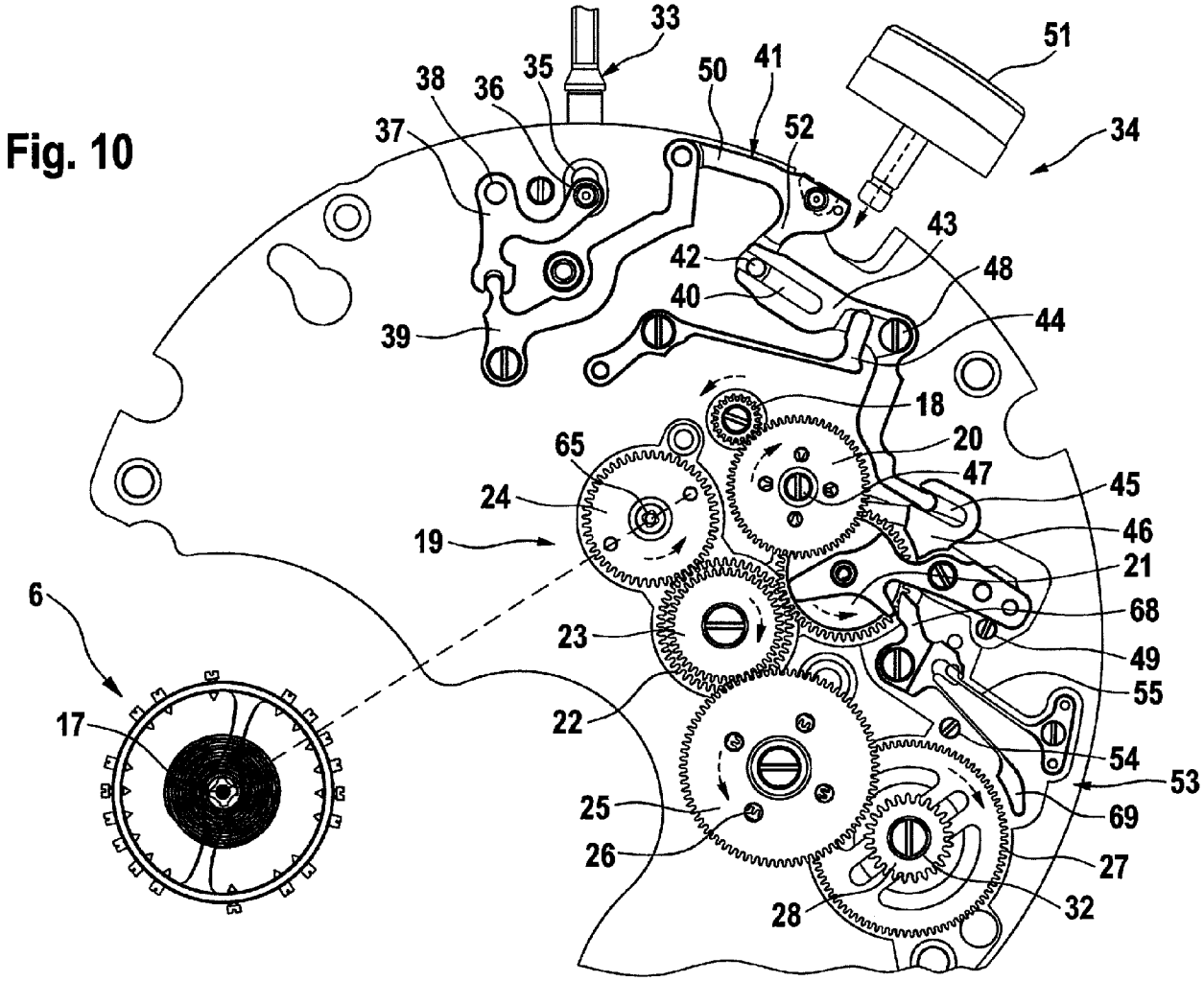
FIG. 10 is a top view of the driving wheel train of the timepiece according to FIG. 1 with a decoupling device in the coupled position with a correction button not in correction engagement.
Figure 11:
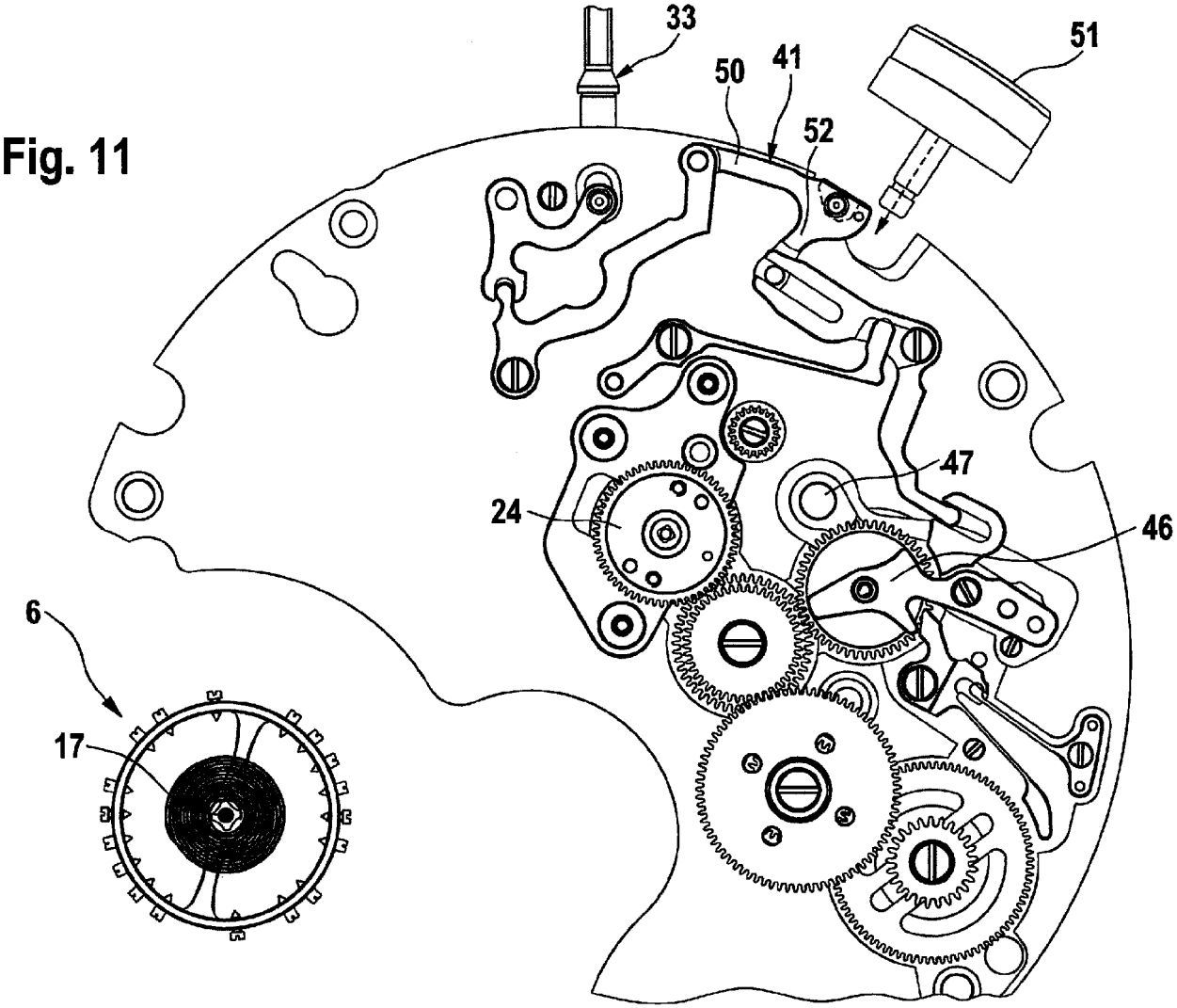
FIG. 11 is a second top view of the driving wheel train of the timepiece according to FIG. 1 with a decoupling device in the coupled position with a correction button not in correction engagement.

As is shown in FIG. 9, a synodic moon revolution has concluded after a complete revolution of the large moon disk 4. The sun (balance 6), the new moon, which is now displayed, and the earth (central disk 1) lie directly in line. From the location 13 of the observer, the moon 15 is not visible at the time of observation. The moon is now illuminated by the sun on its far side.

The construction of the drive of central disk 1, large moon disk 4 and small moon disk 10 is shown in FIGS. 10 to 13 and is described in the following.

Taking from a minute wheel, not shown, which is driven by the timepiece movement of the timepiece with one revolution per hour, a twenty tooth first driving wheel 18 of a gear train 19 is driven via two transmission stages, not shown, with one revolution in four hours. The first driving wheel 18 drives a second driving wheel 20 having sixty teeth with one revolution in twelve hours. A 24 leaf pinion, not shown, of the second driving wheel 20 drives a third driving wheel 21 having forty-eight teeth with one revolution per twenty-four hours, this third driving wheel 21 engaging in a first moon wheel 22 and driving the latter with one revolution per 24 hours.

The first moon wheel 22 drives an earth driving wheel 24 having forty-eight teeth around the central pivot 2 with one revolution per 24 hours. The central disk 1 can be fitted coaxially to the earth driving wheel 24 and driven in rotation by the latter.

Further, a second moon wheel 25 having seventy-seven teeth engages in the first moon wheel pinion 23 and is driven with one revolution per 1.75 days.

A 45 leaf second moon wheel pinion 26 of the second moon wheel 25 drives a third moon wheel 27 having eighty-four teeth with one revolution per 3.26 days, this third moon wheel 27 having a 25 leaf third moon wheel pinion 28 connected to the third moon wheel 27 by slip clutch 32.

Figure 14:
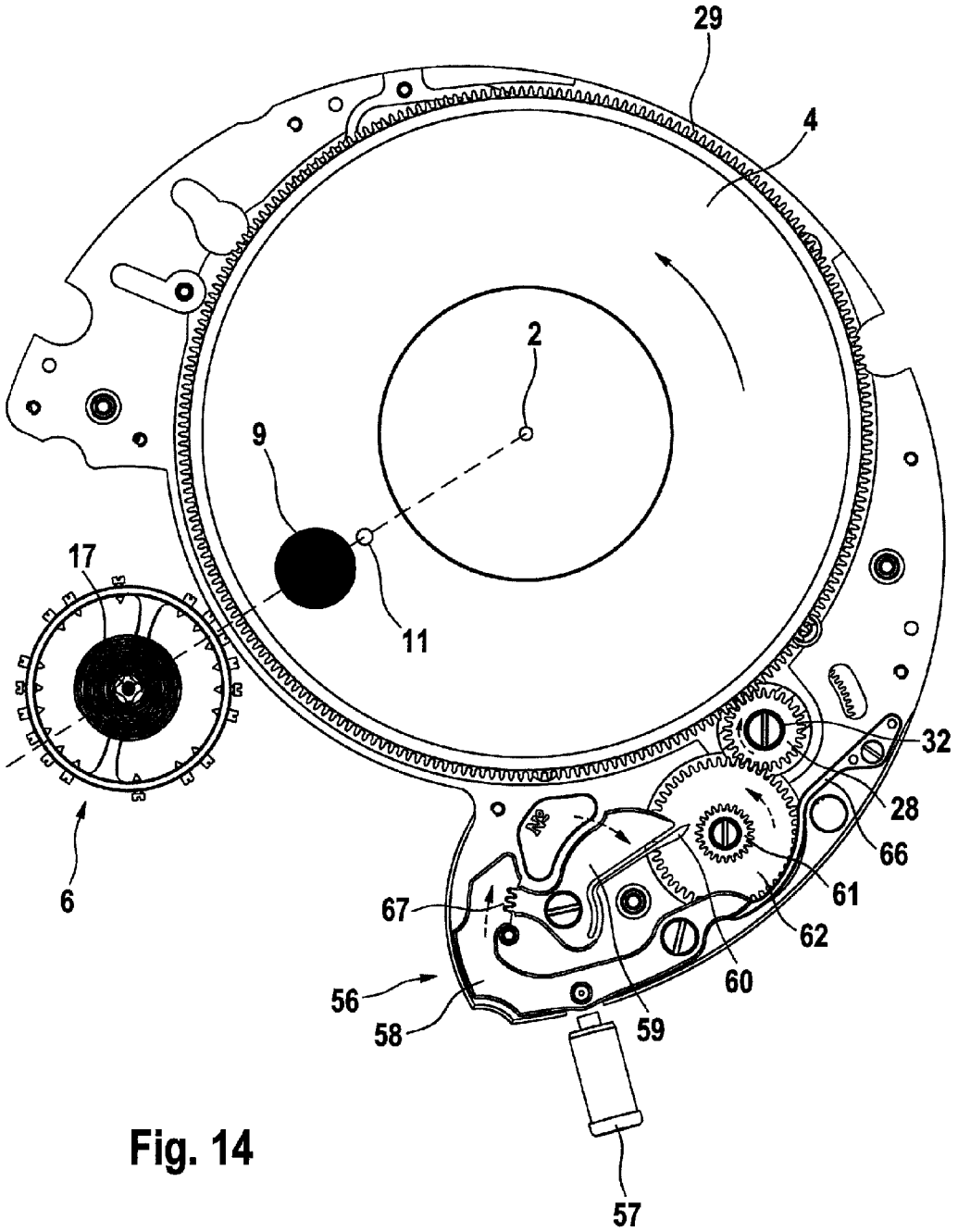
FIG. 14 is a top view of an adjusting device of the timepiece according to FIG. 1 in an idle position.
Figure 15:
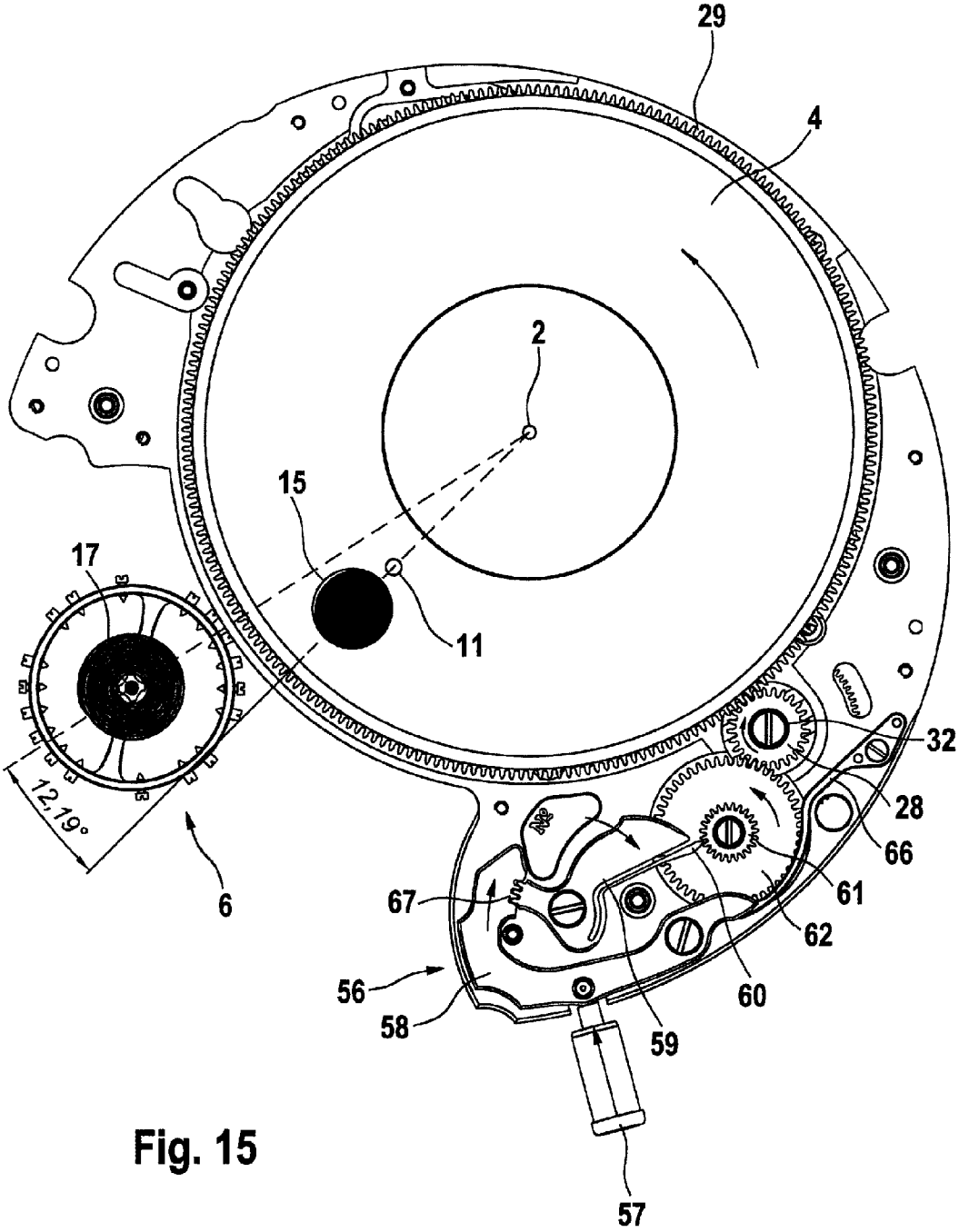
FIG. 15 is a top view of the adjusting device of the timepiece according to FIG. 1 in an adjusting position.

As will be seen in FIGS. 14 and 15, the third moon wheel pinion 28 engages in the radially circumferential 226 tooth moon disk toothing 29 of the large moon disk 4 and drives it with one revolution per synodic month (29 days, 12 hours, 44 minutes, 2.9 seconds) in counterclockwise direction.

As is shown in FIG. 18, the small moon disk 10 is supported so as to be freely rotatable around the moon pivot 11 parallel to the central pivot 2 on the side of the large moon disk 4 remote of an observer of the timepiece.

Figure 16:
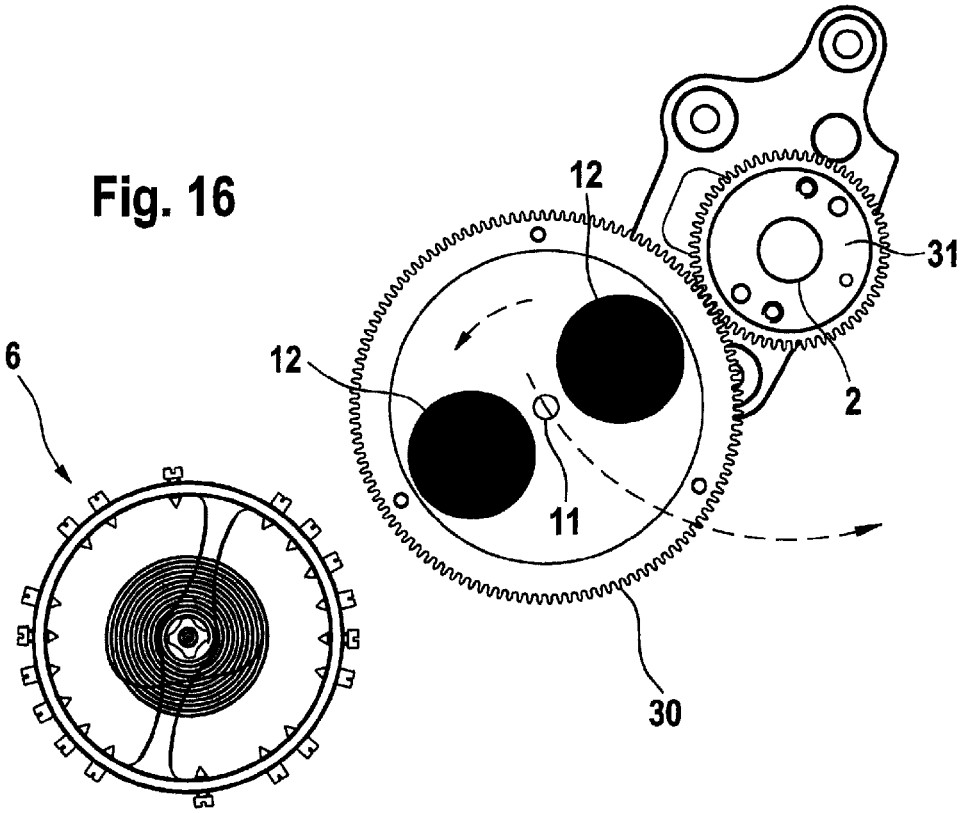
FIG. 16 is a top view of a toothed wheel and balance of the timepiece according to FIG. 1, which toothed wheel is arranged in a stationary manner with respect to the central pivot.

The small moon disk 10 has radially circumferentially a small moon disk toothing 30 of 120 teeth which engages in the toothing of a toothed wheel 31 having sixty teeth arranged in a stationary manner coaxial to the central pivot 2 (FIG. 16).

During a revolution of the large moon disk 4, the small moon disk 10 rolls along the stationary toothed wheel 31. Two new-moon positions of the small moon disk 10 are seen through the moon view aperture 9 by the two dark circular areas 12 on the small moon disk 10, the rest of which is light. With a 180-degree rotation of the large moon disk 4, the small moon disk 10 rotates 90°. After this angular amount, the full moon can be seen through the moon view aperture 9.

Figure 12:
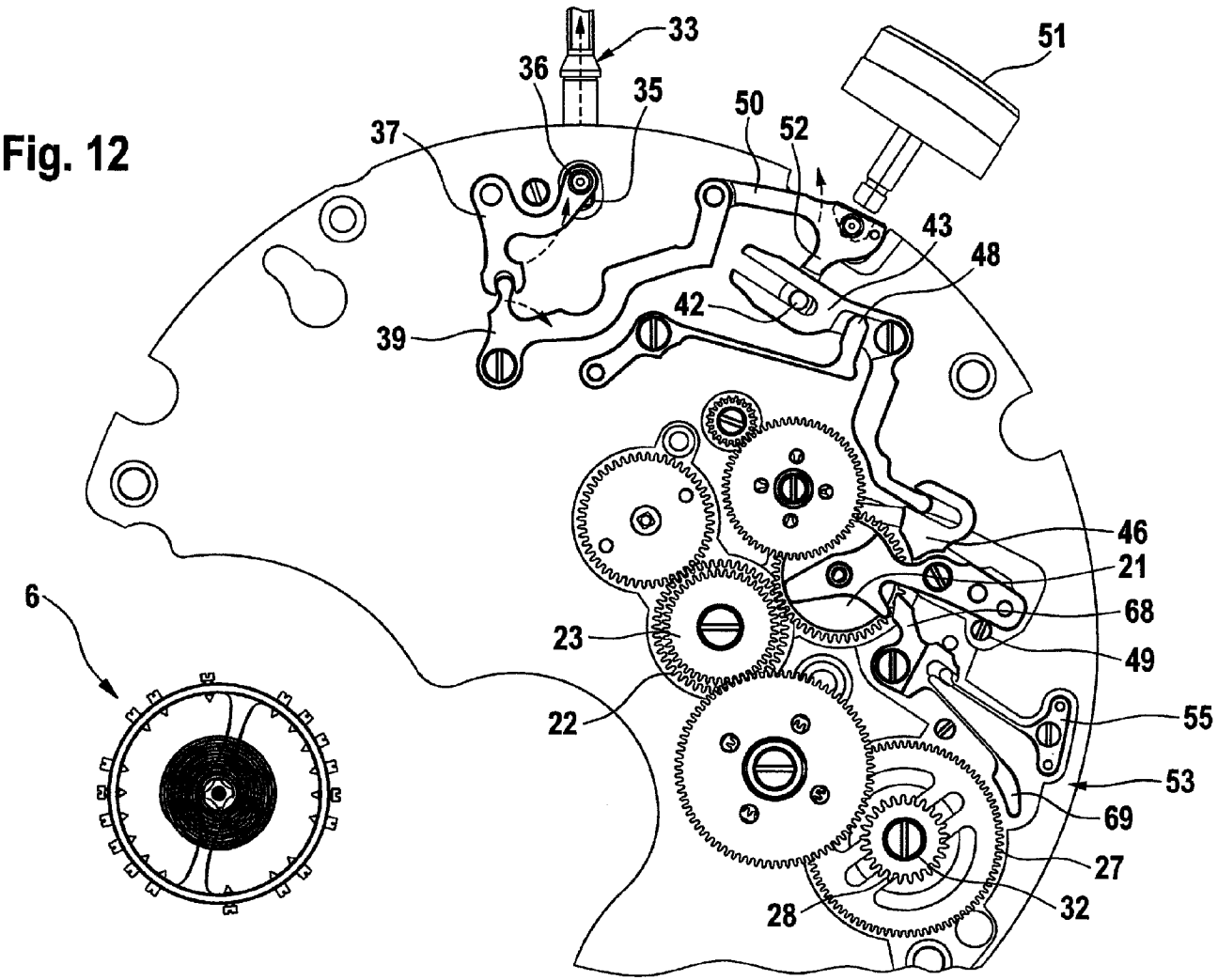
FIG. 12 is a top view of the driving wheel train of the timepiece according to FIG. 1 with a decoupling device in the coupled position with a correction button in correction engagement.
Figure 13:
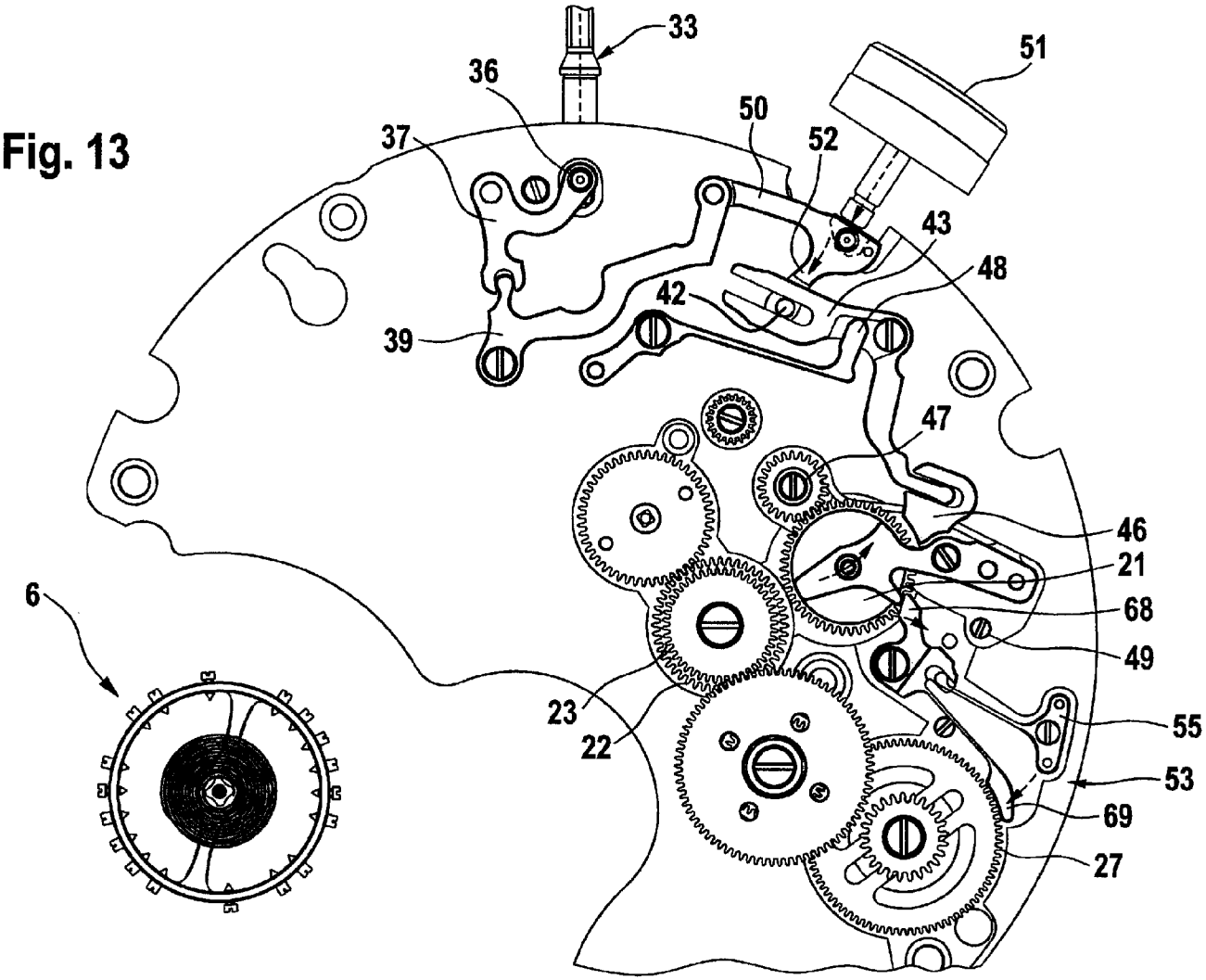
FIG. 13 is a top view of the driving wheel train of the timepiece according to FIG. 1 with a decoupling device in the decoupled position with a correction button in correction engagement.

The timepiece has a winding stem 33 which forms a setting device and which projects radially out of the timepiece and is displaceable in longitudinal extension thereof between an inner winding position (FIGS. 10 and 11) and an outer hand-setting position (FIGS. 12 and 13).

In the winding position, the spring accumulator of the timepiece can be tightened by turning the winding stem 33.

In the hand-setting position, an hour display and possibly a minute display and a seconds display of the timepiece can be adjusted.

To set the hour display and possibly the minute display and the seconds display when changing time zones, the earth (central disk 1) and the large moon disk 4 may not move along. Only the hour display and possibly the minute display and the seconds display are moved. To this end, the gear train 19 is decoupled upstream of the power flow in driving direction for the central disk 1 and large moon disk 4 by a decoupling device 34.

The winding stem 33 has an axial groove 35 into which projects a pin 36 which is arranged at one end of a two-arm corrector swivel lever 37 parallel to the swiveling axis 38 thereof. The other end of the corrector swivel lever 37 is connected in an articulated manner to the one end of a two-arm swivel lever 39 that is connected in an articulated manner at the other end thereof to the one end of an L-shaped slide 41. The end region of the swivel lever 39 connected to the slide 41 extends approximately radially relative to the outer contour, while the arm 50 of the slide connected to the swivel lever 39 extends approximately parallel to the outer contour of the timepiece. At the end of the other arm 52, the slide 41 has a slide pin 42, which is directed parallel to the swivel axes 38 and 39 and which engages in a slide groove 40 at the one end region of a two-arm driving wheel corrector 43. The slide groove 40 extends approximately at right angles to the portion of the slide 41 that carries the slide pin 42 and that also extends approximately radially relative to the outer contour of the timepiece.

The driving wheel corrector 43, which is supported so as to be swivelable around a corrector swiveling axis 48, is acted upon in direction of its longitudinal extension toward the outer contour of the timepiece by a pre-loaded corrector spring 44, which acts on the driving wheel corrector 43 between the slide groove 40 and the corrector swivel axis 48.

At the end of the driving wheel corrector 43 opposite the slide groove 40, this driving wheel corrector 43 engages in a yoke slot 45 of a yoke 46 extending approximately corresponding to the longitudinal extension of the end of the driving wheel corrector 43 projecting into it.

The yoke 46 is mounted so as to be swivelable around a yoke pivot 47, which extends approximately coaxial to the axis of rotation of the second driving wheel 20 at a distance from the slide groove 40.

The third driving wheel 21 is also rotatably supported at the yoke 46 at a distance from the yoke pivot 47.

The yoke 46 is acted upon by the corrector spring 44 in direction of engagement of the third driving wheel 21 in the first moon wheel 22. The yoke 46 contacts a cam stop 49 in the exact engagement position of the third driving wheel 21; the engagement position can be varied to a slight degree by turning the cam stop 49 around the longitudinal axis thereof in order to correct for manufacturing tolerances.

When the winding stem 33 is in the winding position, corrector swivel lever 37, swivel lever 39 and slide 41 are also located in a button deactivating position. This means that a corrector button 51, which can be actuated manually by the observer, cannot be moved into a corrector engagement in the decoupling device 34, so that the latter cannot be activated unintentionally. By moving the winding stem 33 out of its winding position into its hand-setting position, the corrector swivel lever 37 is swiveled in counterclockwise direction by the winding stem 33 and in turn swivels the swivel lever 39 in clockwise direction. This causes the arm 50 of the slide 41 to be displaced approximately parallel to the outer contour of the timepiece into a region in which the corrector button 51 achieves corrector engagement and can act upon the arm 50 transverse to the longitudinal extension thereof.

When the slide 41 is moved radially inward into the timepiece against the force of the corrector spring 44 as a result of the corrector button 51 acting upon the slide 41, the driving wheel corrector 43 is swiveled in counterclockwise direction and drives the yoke 46. This causes the third driving wheel 21 to disengage from the first moon wheel 22.

Shortly before the third driving wheel 21 disengages from the first moon wheel 22, a blocking of the third moon wheel 27 takes place by a braking device because the third moon wheel 27 is now without power in the gear train 19 and, therefore, its setting cannot be adjusted.

The braking device has a swivelable two-arm brake lever 53 that is acted upon by a pre-loaded brake lever spring 55 when the third driving wheel 21 engages in the first moon wheel 22, so that the brake lever 53 is held such that its second arm 69 is lifted from the third moon wheel 27.

When the yoke 46 swivels into the position where the third driving wheel 21 is disengaged from the first moon wheel 22, the yoke 46 moves the first arm 68 of the brake lever 53 against the force of a pre-loaded brake lever spring 55 such that the second arm 69 of the brake lever 53 is pressed into contact with the toothing of the third moon wheel 28 and prevents the latter from rotating.

By turning the winding stem 33, the hour display can now be adjusted by the desired number of hours corresponding to the time zone to be set.

The normal setting of the timepiece is restored by, terminating the action of the corrector button 51 and returning the winding stem 33 to its winding position.

If the timepiece has accidently stopped, no actuation of the corrector button 51 is required, since the lost time must also be recouped in the display of the positions of the central disk 1 (earth) and moon 51.

The large moon disk 4 is adjustable together with the small moon disk 10 in steps of a synodic day by a manually adjustable adjusting device 56 (FIGS. 14 and 15).

The adjusting device 56 has an actuating element, which is formed by an adjusting button 57 and which can be pressed radially into the timepiece by the observer.

This adjusting button 57 impinges on a swivelably mounted first corrector lever 58 such that the latter swivels in clockwise direction against the force of a pre-loaded spring 66 and, in so doing, acts on a second corrector lever 59 via a toothing 67 such that the second corrector lever 59 likewise swivels in clockwise direction out of an idle position. The second corrector lever 59 has a setting nose 60 which engages in the toothing of a reversing wheel pinion 61 as a result of the swiveling of the second corrector lever 59 and rotates the reversing wheel pinion 61 in the counterclockwise direction.

A reversing wheel 62, which is connected coaxially to the reversing wheel pinion 61, engages in the third moon wheel pinion 28 such that the movement of the adjusting button 57 is transmitted to the large moon disk 4 via first adjusting button lever 58, second adjusting button lever 59, setting nose 60, reversing wheel pinion 61, reversing wheel 62 and third moon wheel pinion 28. In this way, the lunar phase is advanced by one day in the synodic month.

In so doing, however, the third moon wheel 27 does not turn because of the slip clutch 32.

Figure 19:
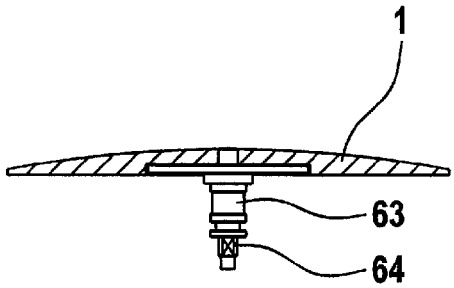
FIG. 19 is a section along line XX-XX in FIG. 20.
Figure 20:
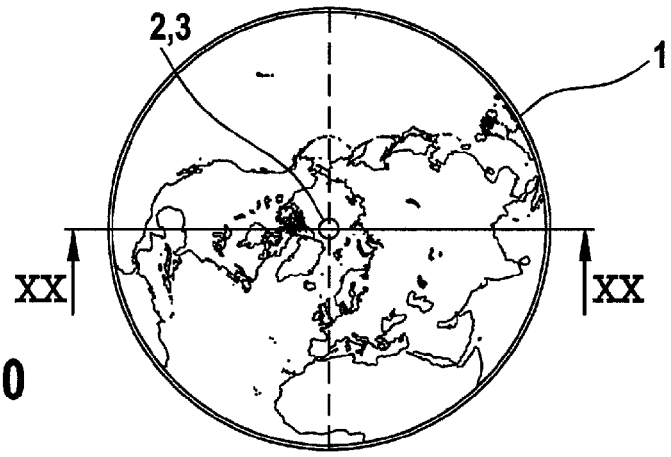
FIG. 20 is a top view of a central disk of the timepiece according to FIGS. 1.

FIGS. 19 and 20 show the central disk 1, which is formed convexly on the side thereof facing the observer and carries the image of the northern hemisphere. The central disk 1 has in its center a coaxial bore forming the north pole 3.

A bearing shaft 63 having a square head 64 formed at the free end thereof is fixedly arranged coaxially at the underside of the central disk 1.

The faces of the square head 64 are oriented parallel to or at right angles to the meridian 16, and it must be ensured when assembling the bearing shaft 63 and central disk 1 that the prime meridian of the image of the northern hemisphere and the square head are aligned with one another. The earth driving wheel 24 has a correspondingly aligned square head recess 65 for receiving the square head 64.

Figure 21:
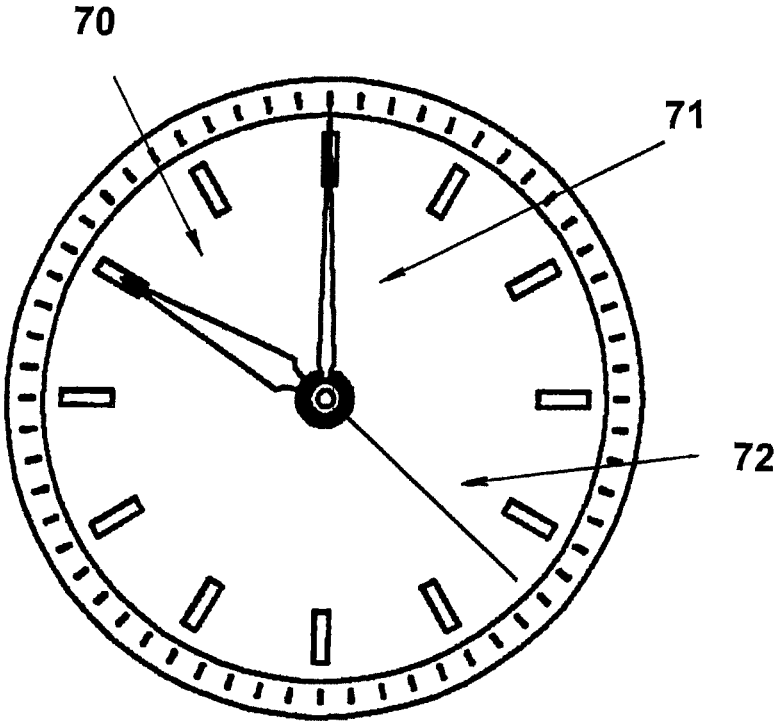
FIG. 21 is a view of the hour display, minute display and second display of the timepiece in accordance with an embodiment of the present invention.

FIG. 21 shows an hour display 70, a minute display 71 and a second display 72 on a clock face that would, e.g., be visible on a side of the timepiece opposite the side showing the large moon disk and the small moon disk.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A timepiece with a timepiece movement by which at least an hour display can be driven, the timepiece comprising:

a central pivot (2);

a central disk (1) drivable so as to be rotatable in a clockwise or counterclockwise direction around the central pivot (2) by one revolution per 24 hours and on the surface of which is depicted the southern hemisphere or northern hemisphere of the earth or the degrees of longitude thereof, wherein the central pivot (2) passes through the pole (3) of the northern or southern hemisphere;

a stationary 24-hour scale (5) arranged concentric to the central pivot (2);

a sun mark arranged in a stationary manner in a 1200 hours position of the 24-hour scale (5) at a radial distance from the central pivot (2);

a large moon disk (4), the central disk (1) being surrounded concentrically radially inside of the 24-hour scale (5) by the large moon disk (4), the large moon disk (4) being rotatably drivable in the counterclockwise direction at a rate of one revolution per synodic month;

a moon view aperture (9) in the large moon disk (4); and a small moon disk (10) mounted at the large moon disk (4) so as to be rotatable around a moon pivot (11) parallel to the central pivot (2), the small moon disk (10) carrying a plurality of dark circular areas (12), corresponding to the moon view aperture (9), which are uniformly distributed on a pitch circle, the small moon disk (10) being rotatably drivable in a ratio to the rotational movement of the large moon disk (4), wherein the dark circular areas (12) are movable successively into registration with the moon view aperture (9) and successively out of registration with the moon view aperture (9) by the rotational movement of the small moon disk (10).

2. The timepiece according to claim 1, wherein the small moon disk (10) is rotatably supported at the large moon disk (4) on a side of the timepiece remote from an observer.

3. The timepiece according to claim 1, wherein the small moon disk (10) carries two dark circular areas (12) and is drivable at half of the rotational speed of the large moon disk (4).

4. The timepiece according to claim 1, wherein the small moon disk (10) has a concentric small moon disk toothing (30) which meshes in a toothing of a toothed wheel (31) arranged in a stationary manner coaxial to the central pivot (2).

5. The timepiece according to claim 1, wherein the large moon disk (4) has a concentric large moon disk toothing (29) in which a driving pinion (28) engages.

6. The timepiece according to claim 5, wherein the timepiece movement comprises a gear train (19), wherein the driving pinion (28) is rotatably drivable via the gear train (19) of the timepiece movement.

7. The timepiece according to claim 6, wherein the central disk (1), large moon disk (4) and small moon disk (10) are rotatably drivable by the timepiece movement via the gear train (19), and the hour display is adjustable when the central disk (1), large moon disk (4) and small moon disk (10) are decoupled from the timepiece movement by a decoupling device (34).

8. The timepiece according to claim 7, wherein the hour display is adjustable by a setting device movable between a setting position and a non-setting position.

9. The timepiece according to claim 8, wherein the decoupling device (34) is adjustable by the setting device between a decoupling position and a non-decoupling position, wherein the timepiece movement is decoupled from the central disk (1), the large moon disk (4) and the small moon disk (10) in the decoupling position and the timepiece movement is coupled with the central disk (1), the large moon disk (4) and the small moon disk (10) in the non-decoupling position.

10. The timepiece according to claim 9, wherein the decoupling device (34) has an actuating element by which the gear train (19) can be decoupled from the timepiece movement for the central disk (1), large moon disk (4) and small moon disk (10) via the decoupling device (34) at a decoupling location in the decoupling position of the decoupling device (34).

11. The timepiece according to claim 10, wherein a part of the gear train (19) downstream of the decoupling location in a driving direction can be locked against rotation when the gear train (19) is decoupled.

12. The timepiece according to claim 11, wherein the large moon disk (4) is manually adjustable in counterclockwise direction.

13. The timepiece according to claim 12, wherein the large moon disk (4) is adjustable in steps of a synodic day.

14. The timepiece according to claim 13, wherein a wheel (28) of the gear train (19) is adjustable by a manually actuatable adjusting device (56) arranged on an arbor by a slip clutch (32), the arbor being fixedly connected coaxially to a further, upstream wheel (27) of the gear train (19).

15. The timepiece according to claim 14, wherein the manually actuatable adjusting device (56) has a first swivel lever (58) which can be swivelably deflected by a second actuating element from an idle position to an adjusting position and by which a second swivel lever (59) can be swivelably deflected, the second swivel lever (59) having a setting nose (60) which engages in the driving pinion (28) or an intermediate toothed wheel through the deflection of the second swivel lever (59) and rotates the driving pinion (28) or intermediate toothed wheel by a synodic day for adjusting the large moon disk (4).

16. The timepiece according to claim 1, wherein the sun mark is formed by the balance of the timepiece arranged radially outside of the hour scale.

17. The timepiece according to claim 1, wherein the timepiece is a wristwatch.

18. The timepiece according to claim 1, wherein the timepiece movement is configured to drive a minute display and a seconds display in addition to the hour display.

19. The timepiece according to claim 1, wherein the synodic month is exactly 29 days, 12 hours, 44 minutes, and 2.9 seconds.

* * * * *